United States Patent [19]

Berger

[11] Patent Number: 4,637,409

[45] Date of Patent: Jan. 20, 1987

[54] TOBACCO SMOKE FILTER AND METHOD AND APPARATUS FOR MAKING SAME

[75] Inventor: Richard M. Berger, Midlothian, Va.

[73] Assignee: American Filtrona Corporation, Richmond, Va.

[21] Appl. No.: 261,690

[22] Filed: May 7, 1981

[51] Int. Cl.[4] ..... A24D 3/04

[52] U.S. Cl. ..... 131/336; 131/339; 131/340; 131/198.1; 131/209; 131/363

[58] Field of Search ..... 131/336, 339, 340, 198.1, 131/209, 361, 362, 363

[56] References Cited

U.S. PATENT DOCUMENTS

| | | | |
|---|---|---|---|
| 3,324,862 | 6/1967 | De Simone | 131/336 |
| 4,149,546 | 4/1979 | Luke | 131/339 |
| 4,256,122 | 3/1981 | Johnson | 131/339 |

FOREIGN PATENT DOCUMENTS

| | | | |
|---|---|---|---|
| 2302677 | 10/1973 | Fed. Rep. of Germany | 131/339 |

*Primary Examiner*—V. Millin

*Attorney, Agent, or Firm*—Holman & Stern

[57] ABSTRACT

An improved tobacco smoke filter is characterized by longitudinally continuous grooves running from end-to-end in the peripheral surface of a smoke-impervious filter plug wrap. Smoke-impervious tipping surrounds the plug wrap to seal the grooves except for small ventilation holes in the tipping which permit communication between the grooves and the ambient air. In a preferred embodiment, the grooves are restricted toward the mouth end of the filter and the degree of restriction determines the direction of air and smoke flow in the grooves. The grooves are each preferably formed as two longitudinal sections of different cross-section. Apparatus and method for manufacturing the filter are disclosed.

39 Claims, 16 Drawing Figures

FIG. 1
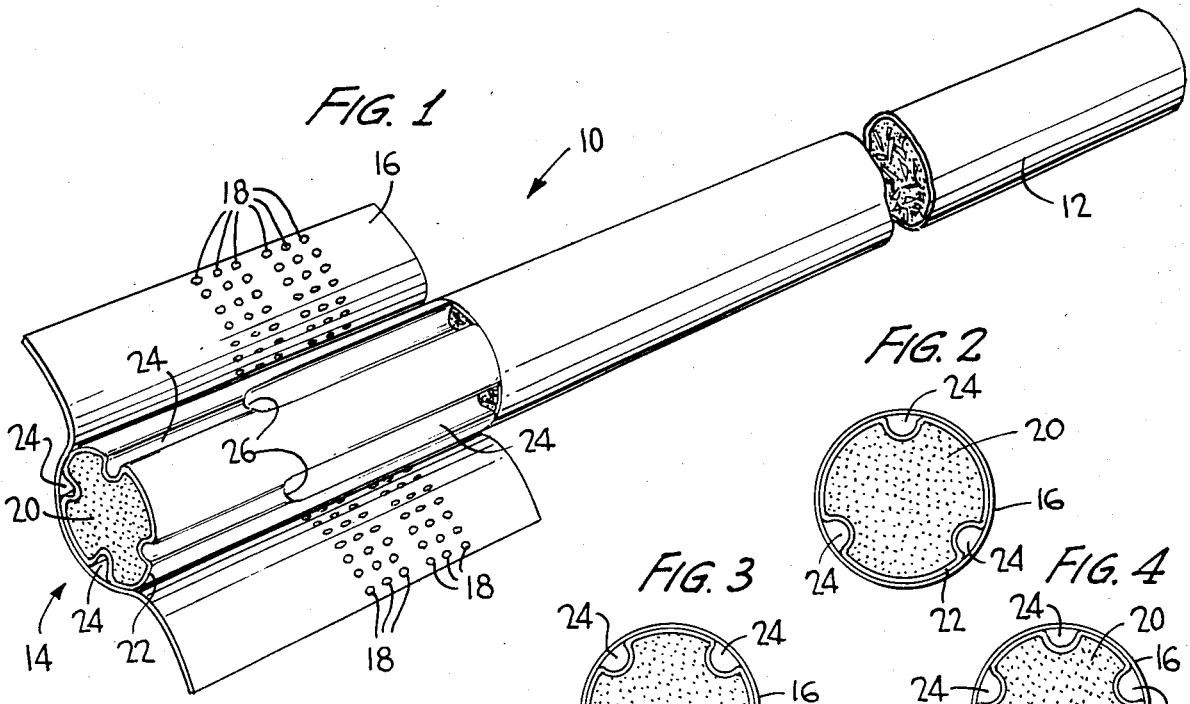
FIG. 2
FIG. 3
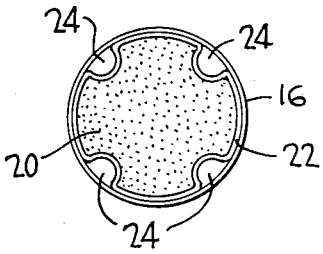
FIG. 4
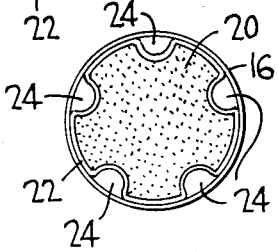
FIG. 5
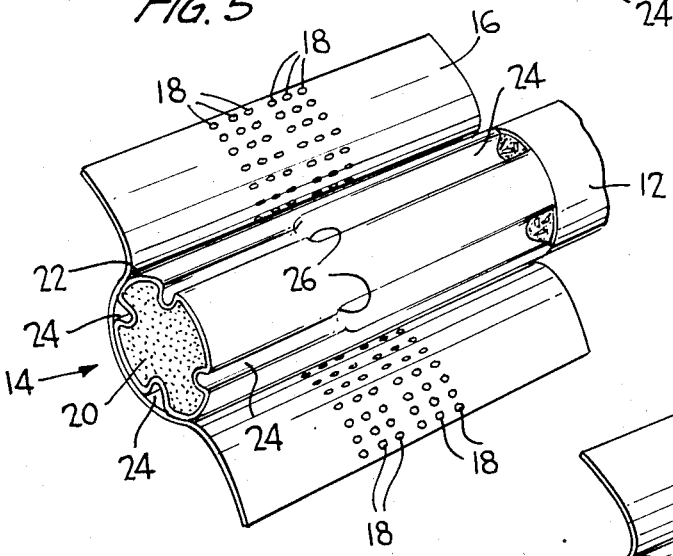
FIG. 6
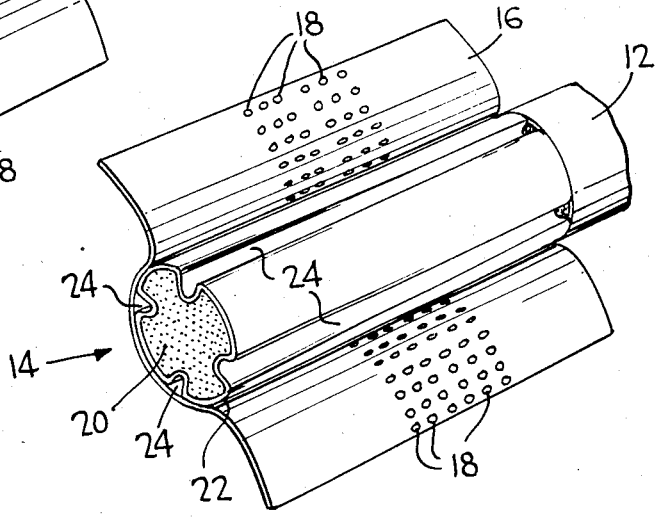

TOBACCO SMOKE FILTER AND METHOD AND APPARATUS FOR MAKING SAME

TECHNICAL FIELD

The present invention relates to filter elements and the fabrication of such filter elements. More particularly, the present invention is primarily concerned with producing filter means for cigarettes, although the products of this invention are generally useful as filters, particularly for tobacco smoking means, whether they be cigarettes, cigars, pipes or the like. Since filters for cigarettes are particularly commercially important, the basic embodiment of the present invention is described as it relates to the production of filtered cigarettes.

BACKGROUND OF THE INVENTION

In making filters for use in connection with cigarettes and the like, a number of different properties of the resultant filter must be taken into consideration. While filtration efficiency (i.e., the ability of the filter to remove undesirable constituents from tobacco smoke) is perhaps the most important property of cigarette filters, filtration efficiency must frequently be compromised in order for the filter to possess a commercially acceptable combination of other properties, including pressure drop, taste, hardness, appearance and cost. For example, the most commonly utilized cellulose acetate filter has a relatively low filtration efficiency since increased efficiency can only be obtained either by increasing the density of the filter material or the length of the filter element, both of which produce a pressure drop across the filter which is excessive and unacceptable from a commercial standpoint.

In recent years, air dilution has become a popular technique for compensating for the relatively low filtration efficiency of cigarette filters having a sufficiently low pressure drop for commercial acceptance. The air dilution technique employs ventilating air to dilute the smoke stream from the cigarette and thereby reduce the quantity of tar and other undesirable tobacco smoke constituents drawn into the smoker's mouth for each puff or draw. The ventilating air is generally provided through a plurality of perforations in the tipping paper employed for joining the filter to the tobacco column of the cigarette, and if the filter is overwrapped with plugwrap paper, an air pervious plugwrap paper is employed.

The air dilution technique has several advantages in that it is the most economical method of reducing tar, it enables achievement of the exact amount of tar delivery desired, and it also contributes to the removal of undesirable gas phase constituents, such as carbon monoxide and nitric oxide. A major disadvantage of the air dilution technique includes lack of taste. In fact, since the introduction of air-diluted cigarettes, manufacturers have gone to great lengths to enhance the taste and/or control the tar delivery of cigarettes. Until the present invention, however, no one has achieved a good tasting cigarette with low CO/tar ratios.

SUMMARY OF THE INVENTION

It is a primary object of the present invention to provide a tobacco smoke filter which permits control over both tar delivery and CO/tar ratios while at the same time offering satisfying taste.

In accordance with the present invention, a conventional cigarette filter is provided with continuous grooves running from one end of the filter to the other. The grooves are formed in the smoke-impervious plugwrap and are sealed by smoke-impervious tipping paper. Ventilating holes are provided in the tipping paper in communication with the grooves to permit diluting air to enter the grooves. In the preferred embodiment of the invention, the downstream end of the grooves are restricted and the degree of restriction determines the flow pattern in the grooves. If the groove flow restriction is greater than the restriction provided by the filter plug, air entering the ventilation holes flows both through the restriction and back up through the grooves to the tobacco end of the filter plug where it is drawn through the filter along with the filtered smoke. If the groove restriction is lower than the flow restriction presented by the filter plug itself, smoke from the tobacco flows down through the grooves and is diluted, when its flow velocity is slowed down by the groove restriction, by air entering the ventilation holes to mix with the smoke. In the preferred embodiment, the groove flow restriction is formed by a downstream section of the groove which has a narrower cross-section than the upstream section of the groove. The ventilation holes in the tipping paper are preferably disposed aligned with the larger upstream section at a location just upstream of the juncture between the two grooved sections.

I have found that by reducing the velocity of the smoke as it passes under the air dilution holes, the CO/tar ratio is significantly reduced. Moreover, the restricted flow path in the grooves act under certain conditions to force the carbon monoxide gas into the atmosphere through the air dilution holes.

Various embodiments are disclosed wherein the cross-sectional area of the grooves varies along the groove length. Also disclosed is a method and apparatus for fabricating the filter of the present invention.

BRIEF DESCRIPTION OF THE DRAWINGS

The above and still further objects, features, and advantages of the present invention will become apparent upon consideration of the following detailed description of the specific embodiments thereof, especially when taken in conjunction with the accompanying drawings, wherein:

FIG. 1 is an enlarged perspective view of one form of cigarette produced in accordance with the present invention, the tipping paper being partially torn away for illustrative clarity;

FIG. 2 is an end view of a filter according to the present invention wherein three (3) longitudinal grooves are provided in the filter;

FIG. 3 is an end view of another filter according to the present invention wherein four (4) grooves are defined in the filter periphery;

FIG. 4 is a view of another filter constructed in accordance with the present invention wherein five (5) grooves are defined longitudinally in the filter;

FIG. 5 is a view similar to FIG. 1 of another embodiment of the present invention;

FIG. 6 is a view in perspective of another embodiment of the filter of the present invention;

DESCRIPTION OF THE PREFERRED EMBODIMENTS

Figure 11:
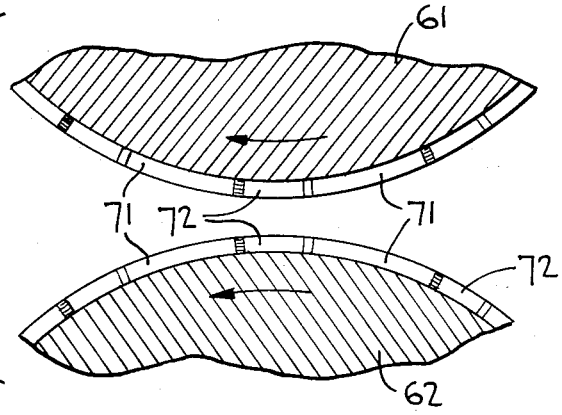
FIG. 11 is a fragmentary elevational view of the crimping means utilized in forming the grooves in the filter plug according the present invention.

Referring to the drawings with greater specificity, and particularly to FIG. 1, a filtered cigarette according to the present invention is designated generally by the reference numeral 10. Cigarette 10 includes a tobacco rod 12 and a filter element 14 constructed in accordance with one embodiment of the present invention. A tipping overwrap 16 secures the tobacco rod 12 and filter element 14 in end-to-end relationship in accordance with well known techniques in this field. The tipping paper overwrap 16 is provided with plural air dilution perforations 18 arranged circumferentially about filter element 14 to permit ventilating air to be drawn through the tipping paper to the filter with each draw or puff of the cigarette.

Filter 14 includes a generally cylindrical plug 20 made of conventional tobacco smoke material and typically is made from a continuous tow of cellulose acetate filamentary material, although other filtering materials may be employed with slight modifications. For example, filamentary tow formed of other materials such as polyethylene, polypropylene, and the like, or even nonwoven staple fibers may be used. It should be understood, however, that cellulose acetate filamentary tow is the preferred material from a commercial standpoint. In this sense, plug 20 is fabricated from conventional material to function as a smoke-pervious filter plug for trapping solid particulates in the smoke passing therethrough.

Plug 20 is circumscribed along its entire length by a non-porous or smoke-impervious plug wrap 22. It will be recognized by those familiar with the art that a smoke-impervious plug wrap includes smoke-impervious outer surfaces of foamed material which is integral with the filter plug as well as smoke-impervious wrapping material which is not integral with the plug. Plural grooves are defined in plug wrap 22 and plug 20 and take the form of recesses having their depth dimension extending radially inward of plug 20 and having their length dimension extending continuously between the two ends of the plug. The particular peripheral plug grooves 24 illustrated in the embodiment of FIG. 1 each have two longitudinal sections, namely: a first large-volume section extending longitudinally inward from the tobacco interface end of plug 20; and a smaller volume section extending longitudinally inward from the mouth end of the filter plug. The two sections of different volume join end-to-end at a common junction 26. In the embodiment illustrated in FIG. 1, common junction 26 is disposed slightly closer to the mouth end of plug 20 than the ventilation holes 18 defined in the tipping paper 16. Thus, those ventilation holes 18 which overlie portions of channels 24 only overlie the larger volume sections of those channels. Apart from the ventilation holes 18 in tipping paper 16, the tipping paper serves to seal grooves 24 to thereby define longitudinally-extending flow passages defined in the periphery of plug 20. These flow passages extend from end-to-end and thereby provide flow communication between the tobacco rod 12 and the mouth of the cigarette smoker.

In the particular embodiment illustrated in FIG. 1, four (4) longitudinally-extending grooves 24 are provided and an end view of this embodiment is illustrated in FIG. 3. An end view of another embodiment having three (3) grooves 24 is illustrated in FIG. 2; likewise, an end view of still another embodiment having five (5) grooves 24 is illustrated in FIG. 4. It will be appreciated that substantially any number of such grooves 24 can be employed to provide a variety of novel end appearances for the cigarette.

The grooves 24 illustrated in FIG. 1 have constant depth throughout their length. The volume change between the two longitudinal sections in each groove is achieved by narrowing the section of the groove extending from the mouth end of the plug 20. In other words, the transverse dimension of groove 24 is narrowed between junction 26 and the mouth end of the cigarette. The effect of this narrowing is to provide a restriction to flow through the groove in the direction toward the mouth end of the plug. The degree of this restriction determines the operating characteristics of the filter. Specifically, in the preferred mode of operation, a suction applied to the mouth end of the cigarette results in smoke from the tobacco rod bypassing the tortuous path in plug 20 and flowing in grooves 24 toward junction 26. In addition, the applied suction tends to draw air into the large-volume sections of grooves 24 upstream of junction 26 so as to dilute the smoke at that location. The restriction provided downstream of junction 26 causes the smoke to slow down and mix with an be diluted by the inflowing air from ventilation holes 18. Therefore, the smoke which flows through the small volume groove section to the smoker's mouth is very much diluted. In addition, I have found that the CO/tar ratio is reduced by using this dual volume groove 24 wherein the large volume section of the groove slows the velocity of the smoke, and the smaller volume section of the groove, after the dilution holes 18, offers a restriction which acts to force some of the carbon monoxide gas out through the dilution holes after the peak suction force of the puff or draw begins to subside.

Another possible mode of operation of the filter of FIG. 1 is obtained when the restriction provided in the small-volume grooved section is large relative to the overall restriction provided in the flow path through the plug 20. Specifically, under such circumstances, the application of a suction force at the mouth end of the filter results in air being drawn into the grooves through ventilation holes 18 in the manner described above. However, if the small-volume section of the grooves has a very high flow impedence or restriction, air will tend to flow in both directions in groove 24; that is, air entering the groove from ventilation holes 18 will flow through the small-volume groove section to the smoker's mouth and through the large volume section to the tobacco end wherein it is immediately drawn back through the filter plug along with the tobacco smoke and into the smoker's mouth. In this mode of operation, the smoke is diluted both within plug 20 and also within the smoker's mouth.

The two modes of operation described above are distinguished solely by the relative flow restrictions provided by the filter plug itself and by the narrowed or smaller volume section of groove 24. In either case, the ventilating air functions to dilute the smoke and thereby reduce the quantity of tar and other undesirable smoke constituents while removing undesirable gas phase constituents such as CO and NO. Importantly, however, this is achieved in the present invention without sacrificing taste.

Figure 1A:
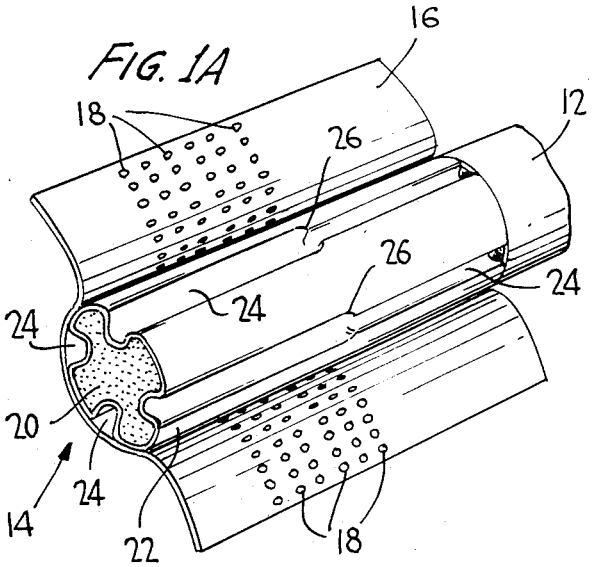
FIG. 1A is a view similar to FIG. 1 but with the filter reversed.

It has even been found that improved CO/tar ratios as compared to commercially available filters can be achieved if the filter 14 of the embodiment of FIG. 1 is reversed as shown in FIG. 1A so that the small-volume sections of the grooves 24 are juxtaposed to the tobacco interface end, but preferably with at least the majority of the air dilution perforations overlying the large-volume sections of the grooves.

The embodiment illustrated in FIG. 5 is similar to that illustrated in FIG. 1 and the same reference numerals are utilized in both figures to designate like elements. The only difference in the embodiment of FIG. 5 resides in the fact that some of the ventilation holes 18 overlap the smaller volume section of grooves 24. This embodiment is more suitable to the second mode of operation described above wherein air flows in both directions in grooves 24. The location of some ventilation holes 18 over the smaller volume section of grooves 24 facilitates flow of air through that section which, by definition under this mode of operation, presents a very restricted flow path.

Another embodiment of the filter of the present invention is illustrated in FIG. 6. Again, the same reference numerals are employed to designate like components in the embodiments of FIGS. 1 and 6. The only difference in the filter of FIG. 6 resides in the fact that the grooves 24 in the embodiment of FIG. 6 have a constant cross-sectional area throughout their length. In other words, there are no larger volume and smaller volume sections. The important feature, however, is that the grooves are continuous, from end-to-end of the filter plug 20, so as to provide a direct flow path from the tobacco end to the mouth end of the filter plug. An applied suction at the mouth end of the filter plug results in smoke flowing toward that end through grooves 24 and also results in ambient air being drawn into grooves 24 through ventilation holes 18. The indrawn air dilutes the smoke flowing down through the grooves 24 to provide the beneficial effects described above. The dilution of the smoke with the embodiment of FIG. 6 is quite effective; however, I have found that the dilution is even more effective when a restriction is employed in grooves 24 as is described in relation to FIGS. 1 and 5. Since there is no restriction in the embodiment of FIG. 6, it may be desirable in some applications to employ more than the usual number of ventilation holes to increase the amount of dilution. Even with a high amount of dilution, which is some cases double the amount of dilution compared to conventional cigarettes, I have found that a good taste is still present at the one mg tar level.

Figure 7:
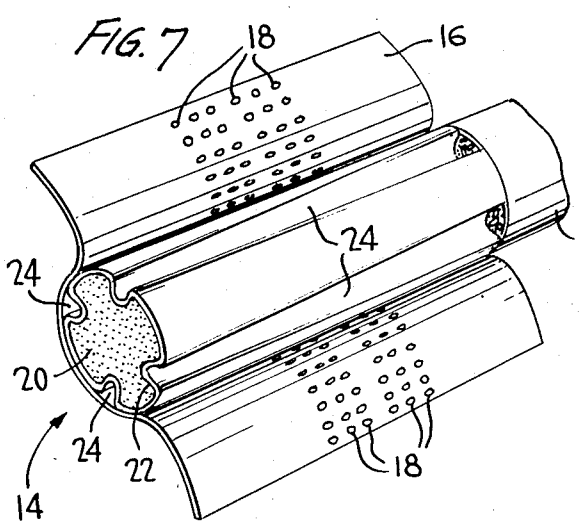
FIG. 7 is a view in perspective of still another embodiment of the filter of the present invention.

It should be noted that when a restriction is employed in grooves 24, such restriction need not be in the form of a discrete change in the cross-sectional area of the groove, such as illustrated in FIGS. 1 and 5. Rather, the width or the depth of grooves 24 can change gradually throughout the length of the plug 20, as illustrated in FIG. 7, so that the restriction has a more gradual effect. The gradual restriction tends to slow down the smoke flow through the grooves so that the incoming air through ventilation holes 18 can effectively dilute the smoke before it reaches the smoker's mouth. In the embodiment illustrated in FIG. 7, the width of the grooves decreases gradually from the tobacco end to the mouth end of the filter plug. The depth can be similarly varied in addition to or as alternative to varying the width. Elements in the embodiment of FIG. 7 bear the same reference numerals as like elements in FIG. 1.

Figure 8:
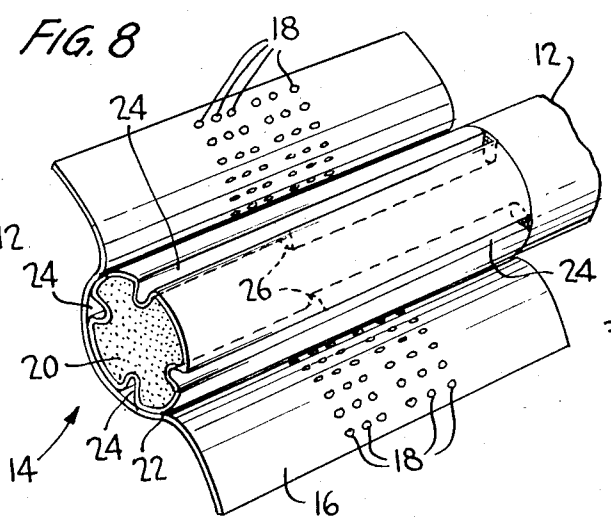
FIG. 8 is a view in perspective of still another embodiment of the present invention.

In the embodiment illustrated in FIG. 8, once again, identical reference numerals are employed to represent corresponding elements in FIG. 1. The difference between the embodiments of FIGS. 1 and 8 resides in the fact that the volume difference between the two sections of grooves 24 is achieved by changing the depth of the groove rather than the width. In all other respects, the filter illustrated in FIG. 8 is identical to the filter illustrated in FIG. 1 and can be employed in either of the two operating modes described hereinabove.

Figure 9:
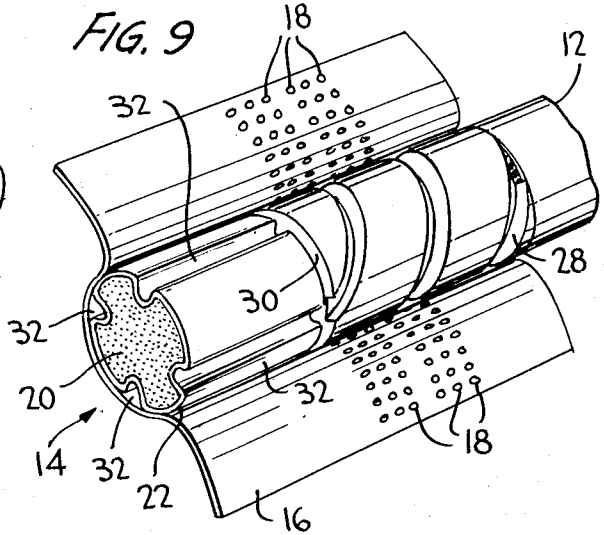
FIG. 9 is a view in perspective of still another embodiment of the present invention.

Referring specifically to FIG. 9 of the accompanying drawings, another embodiment 14 of the filter of the present invention is illustrated. Once again, the same reference numerals are employed in FIG. 9 to designate elements bearing those reference numerals in FIG. 1. The embodiment of FIG. 9 differs from that of FIG. 1 in that the longitudinally-extending grooves 24 of the FIG. 1 embodiment are replaced by a spiral groove 28, an annular groove 30, and longitudinally-extending grooves 32. More specifically, spiral groove 28 extends from the tobacco end of filter 14 in a spiral path about the periphery of the filter to a predetermined location at which the spiral groove 28 terminates in flow communication with annular groove 30. Longitudinally-extending grooves 32 extend into flow communication with annular groove 30 from the mouth end of the filter 14. In the preferred version of the FIG. 9 embodiment, spiral groove 28 has a larger cross-section transverse to flow direction than the cross-section of annular groove 30 and individual longitudinally-extending grooves 32. In addition, as illustrated, the ventilation holes 18 in FIG. 9 are all disposed on the tobacco end side of annular groove so as to align with spiral groove 28 rather than with longitudinally-extending grooves 32 or annular groove 30. In this manner, smoke flow from the tobacco end of the filter to the mouth end of the filter experiences a restriction at annular groove 30 so that air drawn into the spiral groove 28 through ventilation holes 18 can thoroughly mix with and dilute the slowed down smoke in spiral passage 28.

It will be clear that other configurations of grooves can be employed within the scope of the present invention to achieve the results described hereinabove.

The following data represents test results and compares certain characteristics of products made in accordance with the present invention with prior art products.

TABLE I (Four .020" continuous grooves)

| Material Tow | CO | Tar | CO/Tar Ratio |
|---|---|---|---|
| 8/48 | 3.29 mgs. | 6.21 mgs. | 0.53 |
| 5/45 | 2.54 mgs. | 3.85 mgs. | 0.66 |

TABLE I-continued (Four .020" continuous grooves)

| Material Tow | CO | Tar | CO/Tar Ratio |
|---|---|---|---|
| 3.9/48 | 2.16 mgs. | 2.98 mgs. | 0.72 |

TABLE II (Four .020" continuous grooves)

| Material Tow | CO | Tar | CO/Tar Ratio |
|---|---|---|---|
| 8/48 | 1.87 mgs. | 3.73 mgs. | 0.50 |
| 5/45 | 1.19 mgs. | 1.90 mgs. | 0.63 |
| 3.9/48 | 1.36 mgs. | 1.82 mgs. | 0.75 |

TABLE III (Four dual-volume grooves; .040" large volume portion and .020" small volume portion) FIG. 1 Embodiment

| Material Tow | CO | Tar | CO/Tar Ratio |
|---|---|---|---|
| 8/48 | 1.26 mgs. | 2.90 mgs. | 0.43 |
| 3.3/39 | 0.80 mgs. | 1.57 mgs. | 0.51 |

TABLE IV (Four dual-volume grooves; .040" large volume portion and .030" small volume portion) FIG. 1A Embodiment

| Material Tow | CO | Tar | CO/Tar Ratio |
|---|---|---|---|
| 8/48 | 1.85 mgs. | 4.1 mgs. | 0.45 |

TABLE V (Control rods - commercial brand)

| | CO | Tar | CO/Tar Ratio |
|---|---|---|---|
| Control #1 | 2.81 mgs. | 2.57 mgs. | 1.09 |
| Control #2 | 4.54 mgs. | 4.68 mgs. | 0.97 |
| Control #3 | 1.50 mgs. | 1.70 mgs. | 0.88 |
| Control #4 | 0.68 mgs. | 0.75 mgs. | 0.91 |

In Table I, test data is listed for three (3) different tests utilizing the embodiment of FIG. 6 wherein grooves 24 have a constant cross-section throughout their length. Three (3) tests are illustrated, each with a different material tow, the carbon monoxide, tar and CO/tar ratio being designated in the table for each test. The constant diameter of groove 24 employed for the test illustrated in Table I is 0.020" as can be seen from Table I, the CO/tar ratio is quite small for all of the different material tows tested.

Table II illustrates similar tests, again employing the embodiment of FIG. 6 but wherein the diameter of grooves 24 is enlarged to 0.030" as seen in the listed data, the carbon monoxide and tar content is reduced from the data in FIG. 1, whereas the relatively low CO/tar ratio remains substantially the same.

Even more dramatic illustration of the value of the present invention is provided by Table III wherein data is listed for tests run on the embodiment of FIG. 1. In these tests, the volume ratio between the large volume section and small volume section of grooves 24 was selected at 2:1. Specifically, the diameter of the large volume section was 0.040" while the diameter of the small volume section is 0.020". The carbon monoxide and tar content data shows a considerable reduction, even from Tables I and II, and the CO/tar ratio is dramatically reduced.

Similar improvement in CO/tar ratio is seen in Table IV wherein the filter has been reversed as seen in FIG. 1A.

Table V lists the data taken for four (4) commercial brand cigarettes used as controls for the tests listed in Tables I, II, III and IV. The four (4) commercial brand control cigarettes were taken from different packs of a brand which employ a filter similar to that described and illustrated in U.S. Pat. No. 4,256,122.

There are a number of conclusions which can be made from the data listed in the foregoing tables. For one thing, since normal mechanical filters do not filter carbon monoxide, the large D/F fiber, which has a low filter efficiency, improves the CO/tar ratio. The data in Tables I, II, III and IV illustrate this point. Further, by reducing the velocity of smoke as it passes under the air dilution holes, the CO/tar ratio is lowered significantly. This is demonstrated by comparing Tables I and II with one another, wherein the larger volume groove reduces the CO/tar ratio somewhat; it is further proven by comparing the data in Tables III and IV to the data in Tables I and II, wherein the change in volume of grooves 24 modifies the velocity of the smoke and permits more effective dilution. In any case, all of the filters tested of the present invention, show a marked improvement in CO/tar ratio over the control cigarettes for which test data is listed in Table V. Therefore, the continuous end-to-end grooves provide a more effective control over the CO/tar ratio which can be controlled by modifying the sizes of the grooves in relation to the air ventilation holes 18. Importantly, during the tests represented by Tables I–IV, the filters of the present invention offered satisfying taste in spite of the relatively low tar delivery.

FIGS. 10–15 illustrate the overall method and means utilized to fabricate filter elements in accordance with the present invention. Basically, this overall technique is similar in many respects to the techniques described and illustrated in detail in U.S. Pat. Nos. 3,637,447; 4,046,063; and 4,075,936, all of which are expressly incorporated herein by reference. According to the preferred embodiments of the present invention, the filtering material utilized in production of filter elements, is a continuous filamentary tow, designated generally by the reference numeral 40, which includes a multiplicity of bondable fibrous members activated by contact with a hot fluid such as steam. Filtering material 40 is continuously passed into and through an elongated bonding zone 50 which includes a conventional stuffer jet 41 and steam head 42, similar to nature in those shown in various of the above-mentioned prior art patents. Following the steam treatment, the resulting rod is cooled at cooling head 43 before being overwrapped in garniture means 51 with a conventional plug wrap material 45. The plug wrap material 45, which is impervious to smoke, is treated with glue or adhesive at 44 to assure bonding of the overwrap. Garniture 51 provides a continuous pulling mechanism which draws the rod through these initial processing stages.

Upon leaving the garniture 51, the overwrapped rod is subjected to water and steam treatment at water head 46, prior to formation of the grooves 24 in the rod. The grooves are formed by means of heated crimper wheels in crimping mechanism 47, portions of which are described below in relation to FIGS. 11–15. After the grooves are formed in the periphery of the rod, the rod is passed to a cooling head 48 through which it is continuously pulled by a second garniture means 52, which passes the crimped rod to a cutter head 49. The rod is severed transversely at selected locations at cutter head 49 to provide the individual filter plugs.

Figure 13:
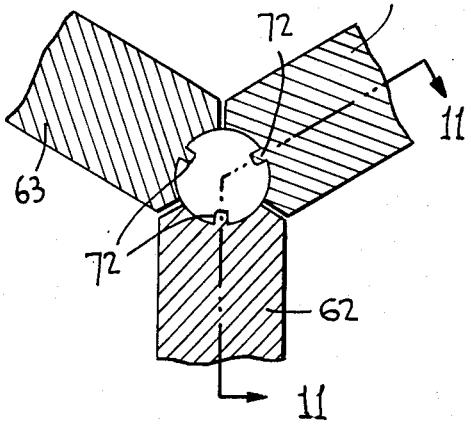
FIGS. 13, 14, and 15 are possible sectional views taken along lines A—A in FIG. 11, each of the embodiments of FIGS. 13, 14, and 15 being capable of defining a different number of grooves in the periphery of a filter plug.
Figure 12:
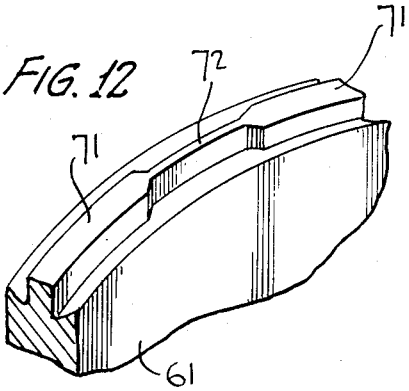
FIG. 12 is a fragmentary view in perspective showing the details of one of the crimping members of FIG. 11.
Figure 10:
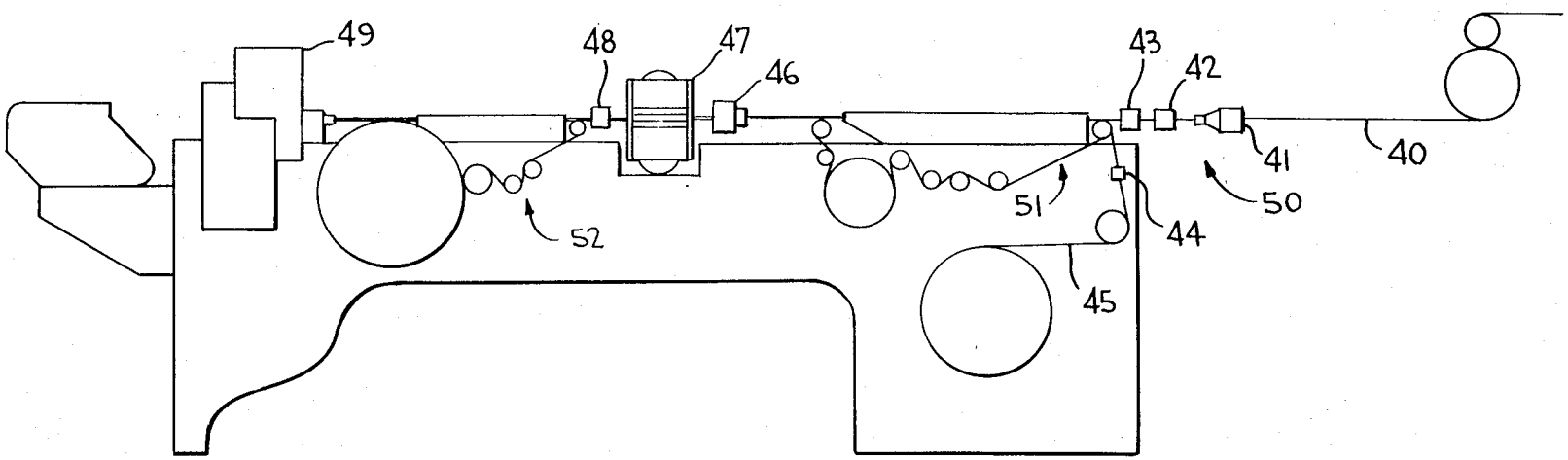
FIG. 10 is a schematic view of a method and means for making filter elements according to the present invention.

All of the elements described with respect to FIG. 10 are conventional except for the heated crimper wheels in the crimper mechanism 47. These wheels are shown in detail in FIGS. 11, 12, and 13 to which specific reference is now made. If three (3) longitudinally-extending continuous grooves are to be provided in the filter plug, three (3) wheels 61, 62, and 63 are provided in the relative positioning illustrated in FIG. 13 wherein the crimping surfaces of the wheels are arcuately formed to permit the filter rod to pass therethrough while being crimped. Crimping projections 71, 72 extend peripherally about each wheel into the passage space for the filter rod. The crimping projections illustrated in FIGS. 11–13 are designed to form the embodiment illustrated in FIG. 1 of the present invention. Thus, projections 71 and 72 extend the same radial distance from the periphery of respective wheels 61, 62, and 63 (as best illustrated in FIGS. 11 and 12) but sections 71 and 72 have different widths. These different widths correspond to the different widths of grooves 24 in FIG. 1. Thus, the projections 71 and 72 extend continuously about the periphery of the wheels 61, 62 and 63 so that a continuous longitudinally-extending channel made up of alternate width sections is defined by each crimping wheel in the filter rod passed through the crimping means 47.

Figure 14:
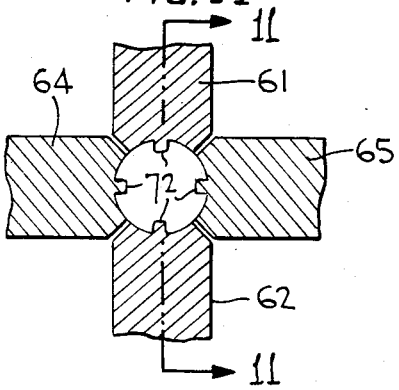
Figure 15:
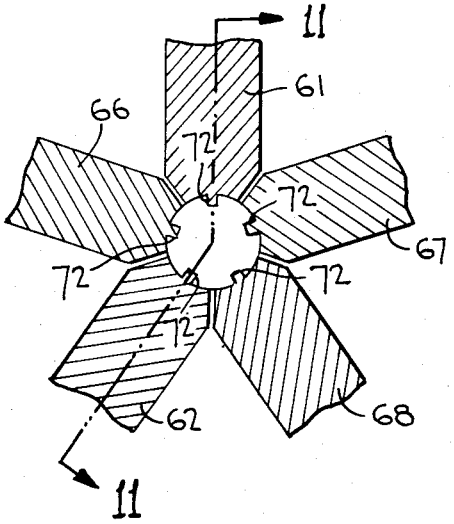

FIG. 14 illustrates how four (4) longitudinally-extending and continuous channels may be defined in the filter rod whereas FIG. 15 illustrates how five (5) such channels may be defined. Clearly, any number of such channels may be employed and the number of gearing wheels selected accordingly. It should also be noted that the projections 71, 72 can be contoured accordingly to provide the desired configuration of the continuous channel. Specifically, in order to provide the different depth sections of the FIG. 8 embodiment, crimping projections 71 and 72 would be provided with different heights but the same width. Likewise, to provide the tapered configuration of the FIG. 7 embodiment, successive width-tapered or depth-tapered (or both) projections would be disposed about the periphery of the various crimping wheels.

Referring again to FIG. 10, when the filter rod having continuous, end-to-end grooves defined therein, is passed to the cutter mechanism 49, the transverse cuts are provided at longitudinal locations which correspond to transitions between the larger and shorter groove sections. These cuts may be made to provide individual plugs at the time of cutting or, alternatively, the cuts may correspond to multiple plug sections which are later severed to provide individual plugs in conjunction with the tipping application process.

It will be apparent to those familiar with this art, that there has been described and illustrated herein, a snoke filter and method and means for manufacturing such filter, which satisfy the various objectives set forth hereinabove and which provide significant commercial advantages. While the present invention has been described with reference to the presently preferred exemplary embodiments thereof, it should be clearly understood that the invention is not limited thereto, but may be variously practiced within the scope of the following claims.

I claim:

1. A smoke filter including a filter element comprising:

a smoke-pervious filter rod having first and second longitudinally-spaced ends;

smoke-impervious rod wrap means wrapped about said filter rod, said rod wrap means being recessed into said filter rod to define at least one continuous grooved portion of said rod wrap means extending from said first end to said second end wherein said grooved portion has a transverse cross-sectional area which varies as a function of the longitudinal displacement from said first end of said filter rod; and tipping means disposed about said rod wrap means to cover said grooved portion, said tipping means being made of material which is impervious to smoke, said tipping means including ventilation means for providing gas flow communication between said grooved portion and ambient air.

2. The smoke filter according to claim 1 wherein said cross-sectional area has two discrete configurations.

3. The smoke filter according to claim 2 wherein said grooved portion has a constant width dimension throughout its length and has at least two different transverse dimensions at different parts of its length.

4. The smoke filter according to claim 2 wherein said ventilation means includes a plurality of holes defined through said tipping means at a location aligned with only one of said discrete cross-sectional area configurations.

5. The smoke filter according to claim 2 wherein said discrete cross-sectional area configurations are respective longitudinally aligned first and second sections of said grooved portion, said first section having a larger cross-sectional area than said second section and meeting said first section at a junction in end-to-end relation, and wherein said ventilation means comprises a plurality of holes defined in said tipping means aligned with said first section proximate said junction.

6. The smoke filter according to claim 5 wherein the ratio of volumes of said first grooved portion section to said second grooved portion section is at least two to one.

7. The smoke filter according to claim 5 wherein the ratio of volumes of said first grooved portion section to said second grooved portion section is approximately three to one.

8. The smoke filter according to claim 2 wherein said two discrete configurations include a first configuration having a first transverse dimension and a second configuration having a second transverse dimension different from said first transverse dimension.

9. The smoke filter according to claim 8 wherein said grooved portion has a constant depth dimension about its length.

10. The smoke filter according to claims 8 or 6 wherein said two discrete configurations are substantially constant throughout the length of respective longitudinal sections of said grooved portions, the section having the larger cross-sectional area extending longitudinally inward from said first end of said filter rod, the other section extending longitudinally inward from said second end of said filter rod, said two sections meeting end-to-end at a common junction, and wherein said ventilation means includes plural holes defined in said tipping means and aligned with the section having the larger cross-sectional area at a location proximate said common junction.

11. The smoke filter according to claim 1 wherein said transverse cross-sectional area decreases gradually with displacement from said first end of said filter rod.

12. The smoke filter according to claim 1 wherein said grooved portion extends spirally about said filter rod for at least part of the rod length.

13. The smoke filter according to claims 1 or 5 further comprising a tobacco rod secured to one end of said filter rod in longitudinal end-to-end relation.

14. A smoke filter including a filter element comprising:

a smoke-pervious filter plug having first and second ends through which smoke to be filtered flows from said first end to said second end;

smoke-impervious wrap means wrapped circumferentially about said plug;

tipping means secured to and disposed about said wrap means and made of material which is impervious to smoke and air;

flow passage means recessed into said plug and wrap means and covered by said tipping means, said flow passage means extending continuously from said first end to said second end of said plug wherein said flow passage means has at least first and second sections of different cross-sectional area; and smoke dilution means, in the form of plural ventilation holes defined through said tipping means in alignment with said flow passage means, for admitting ambient air into said flow passage means in response to application of a suction force through the second end of said plug.

15. The smoke filter according to claim 14 wherein said first and second sections extend longitudinally inward from said first and second ends, respectively, and meet end-to-end at a common junction, wherein the cross-sectional area of said first section is larger than the cross-sectional area of said second section.

16. The smoke filter according to claim 15 wherein said ventilation holes are aligned with said first section proximate said junction and are not aligned with said second section.

17. The smoke filter according to claim 16 wherein the ratio of the volume of said first section to the volume of said second section is at least two to one.

18. The smoke filter according to claim 14 wherein said flow passage means forms a spiral about at least part of the length of said plug.

19. The smoke filter according to claim 14 wherein said flow passage means has a cross-sectional area which gradually reduces from said first end to said second end of said plug.

20. A filtered cigarette comprising, in combination, a tobacco rod and a filter means secured in end-to-end relationship to one end of said tobacco rod, said filter means including a filter element as defined in claim 14.

21. A smoke filter including a filter element comprising:

a smoke-pervious filter plug having first and second longitudinally-spaced ends through which smoke to be filtered flows from said first end to said second end;

smoke-impervious wrap means wrapped circumferentially about said plug;

tipping means secured to and disposed about said wrap means and made of material which is impervious to smoke and air, said tipping means having a plurality of ventilation openings defined therethrough to provide communication between predetermined portions of said wrap means and ambient air; and at least one flow path defined as a recess in said wrap means and covered by said tipping means, said recess extending from said first end to said second end of said plug and traversing at least some of said predetermined portions of said wrap means, said flow path including means responsive to a positive differential pressure applied from said first end to said second end of said plug and said flow path for drawing ambient air into said flow path through said ventilation openings and directing the drawn air through said flow path towards said first and second ends of said plug simultaneously.

22. The smoke filter according to claim 21 wherein said flow path includes a first flow restriction means for impeding air flow through said ventilation openings to said second end of said plug, wherein said filter further includes means for conducting flow between the flow path and the interior of said plug at said second end, and wherein the plug presents a second flow restriction from said first end to said second end which impedes flow to a lesser degree than said first restriction means.

23. The smoke filter according to claim 22 wherein said flow path has a cross-sectional area which decreases gradually with distance from said first end of said plug, the flow path thereby having its smallest cross-sectional area at said second end to define said first flow restriction means.

24. The smoke filter according to claim 22 wherein said means for conducting flow is a portion of a cigarette tobacco rod having an end secured to said first end of said plug such that plug and tobacco rod are substantially coaxially aligned.

25. The smoke filter according to claim 22 wherein said flow path comprises at least first and second discrete sections of different cross-sectional area, the first section having a smaller cross-sectional area and being disposed closer to said second end of said plug than the second section which has a larger cross-sectional area, the first section thereby providing a first flow restriction means.

26. The smoke filter according to claim 25 wherein said first and second sections have the same recess depth and different recess widths.

27. The smoke filter according to claim 25 wherein said first and second sections have the same recess width and different recess depths.

28. The smoke filter according to claim 25 wherein at least part of said flow passage extends spirally about said plug.

29. The smoke filter according to claim 25 wherein said ventilation openings are aligned with said flow path only at said second section.

30. A smoke filter including a filter element comprising:

a smoke-pervious filter plug having first and second longitudinally-spaced ends through which smoke to be filtered flows from said first end to said second end;

smoke-impervious wrap means wrapped circumferentially about said plug;

tipping means secured to and disposed about said wrap means and made of material which is impervious to smoke and air, said tipping means having a plurality of ventilation openings defined therethrough to provide communication between predetermined portions of said wrap means and ambient air; and at least one flow path defined as a recess in said wrap means covered by said tipping means, said recess extending from said first end to said second end of said plug and traversing at least some of said predetermined portions of said wrap means, said flow path including means responsive to a positive differential pressure applied from said first end to said second end of said plug and said flow path for drawing ambient air into said flow path through said ventilation means and directing the drawn air through said flow path towards said second end while simultaneously drawing gas into said flow path from said first end and directing the drawn gas towards said second end and out through said ventilation holes.

31. The smoke filter according to claim 30 wherein said flow path includes a first flow restriction means for impeding air flow from said ventilation openings to said second end of said plug, wherein said filter further includes means for conducting flow between said flow path and the interior of said plug at said second end, and wherein the plug presents a second flow restriction from said first end to said second end to impede flow to a greater degree than the first restriction means.

32. The smoke filter according to claim 31 wherein said flow path comprises at least first and second discrete sections of different cross-sectional area, the first section having a smaller cross-sectional area and being disposed closer to said second end of said plug than is the second section with a larger cross-sectional area, the first and second sections meeting end-to-end at a common junction, the first section thereby providing said first flow restriction means.

33. The smoke filter according to claim 32 wherein said ventilation openings are aligned with said flow passage only at said second section proximate said common junction.

34. The smoke filter according to claims 32 or 33 wherein said first and second sections have the same recess depth and different recess widths.

35. The smoke filter according to claims 32 or 33 wherein said first and second section have the same recess width and different recess depth.

36. The smoke filter according to claims 32 or 33 wherein at least part of said flow passage extends spirally about said plug.

37. The smoke filter according to claim 31 wherein said flow path has cross-sectional area which decreases gradually with distance from said first end of said plug, the flow path thereby having its smallest cross-sectional area at said second end to define said first flow restriction means.

38. The smoke filter according to claim 37 wherein said means for conducting flow is a portion of the tobacco rod having an end secured to said first end of said plug such that said plug and tobacco rod are substantially coaxially aligned.

39. The method of filtering cigarette smoke in a filter of the type including a smoke-pervious filter plug through which smoke is drawn and filtered, said method comprising the steps of:

drawing a portion of the cigarette smoke through an unfiltered passage along the outside of said filter plug in parallel flow arrangement with the flow through the plug; and diluting said portion of the smoke in said unfiltered passage by slowing down the smoke flow at a location in said passage and introducing air into the passage at said location.

* * * * *